United States Patent [19]

Levy

[11] Patent Number: 4,657,330

[45] Date of Patent: Apr. 14, 1987

[54] FIELD INSTALLABLE MODULAR TELEPHONE CONNECTOR

[75] Inventor: Sidney Levy, Belle Mead, N.J.

[73] Assignee: Thomas & Betts Corporation, Raritan, N.J.

[21] Appl. No.: 861,191

[22] Filed: May 8, 1986

Related U.S. Application Data

[63] Continuation of Ser. No. 577,109, Feb. 6, 1984, abandoned.

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 4,040,699 | 8/1977 | Rasmussen | 339/91 R |
| 4,083,615 | 4/1978 | Volinskie | 339/17 F |
| 4,160,573 | 7/1979 | Weisenburger | 339/99 R |
| 4,488,768 | 12/1984 | Sigmon | 339/99 R |

*Primary Examiner*—Joseph H. McGlynn

*Attorney, Agent, or Firm*—Robert M. Rodrick; Salvatore J. Abbruzzese

[57] ABSTRACT

An electrical connector for use as a telephone plug or jack is assembled without need of special tooling and comprises a housing for receiving an insert member. The insert member supports a plurality of contacts thereon, each contact having a first end for external connection to the contacts of another jack or plug and a second end portion of insulation-displacing type. A conductor support element secures telephone cable conductors therein and is engaged with the housing to place the conductors in insulation-displaced engagement with the contact second end portions. A twenty-five pair telephone connector utilizing a modified version of the jack includes, in its preferred form, a base having first and second pluralities of compartments separated by a fold section. The fold section defines a channel for receipt of conductors of a multiconductor telephone cable. The folded base places the jack housings in abutting relation for retention therein, securement means holding such base in its closed, folded condition. Excessive electrical interfacing with attendant disadvantage in electrical resistance is thereby reduced.

16 Claims, 17 Drawing Figures

FIG. 7
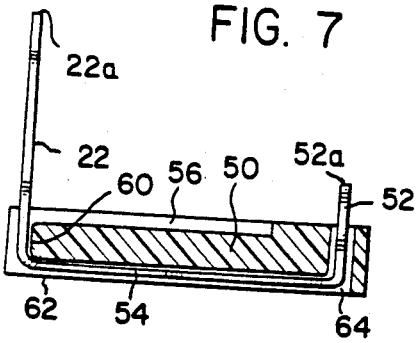
FIG. 8
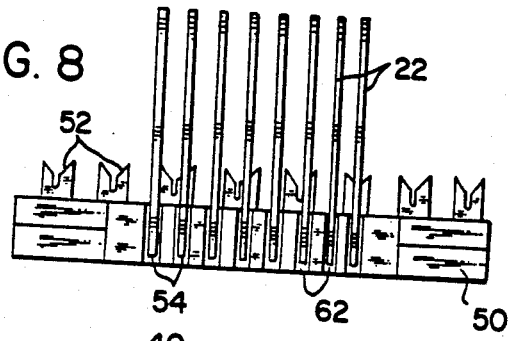
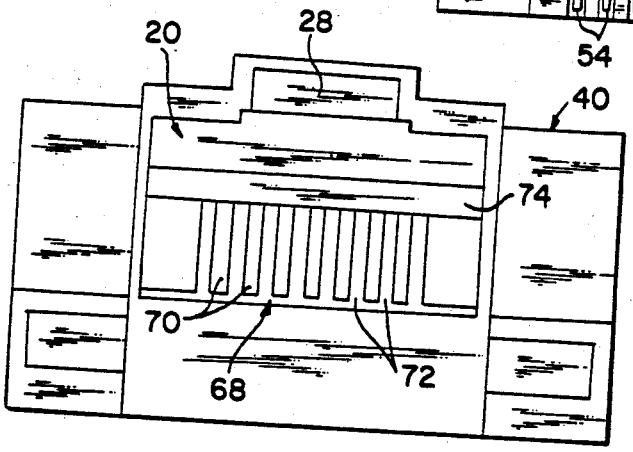
FIG. 10
FIG. 9
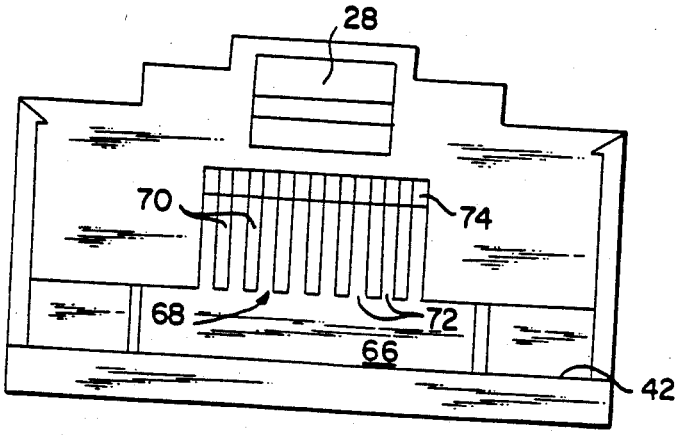

FIELD INSTALLABLE MODULAR TELEPHONE CONNECTOR

This is a continuation of application Ser. No. 577,109, filed Feb. 6, 1984, now abandoned.

FIELD OF THE INVENTION

This invention relates generally to electrical connection apparatus and methods and pertains more particularly to modular telephone interconnection apparatus and methods for field use without special tooling require- ments.

BACKGROUND OF THE INVENTION

Various industry standards have evolved in the telephone industry as respects interconnection to a telephone instrument. Multiconductor telephone cable is typically preassembled in a factory setting in given diverse lengths with modular plugs or jacks which present contacts in compatibly interrelated configuration. Field installation is accordingly made on a modular basis, i.e., using inventoried fully-assembled cable, jack and plug units. The extant commercial units are shown typically in Hardesty U.S. Pat. No. 3,699,498.

Cable having four, six or eight conductors is terminated in a single jack or plug with a single connectorized internal connection interface, i.e., between the conductors and jack or plug contacts. While these devices are insufficient as respects field changes in installation, this and other difficulty attends cable of twenty-five pair type.

In the case of twenty-five pair cable, the present industry standard practice is to rely on a housing having a plurality of modular telephone jacks, wherein the jack contacts are spliced to wires in turn spliced to secondary plug contacts. The secondary plug contacts engage secondary jack contacts which are in turn connected to the conductors of the twenty-five pair cable. Five connection interfaces exist as between the cable conductors and the primary, i.e., modular telephone jack output contacts. Evident electrical resistance disadvantage attends the multiple connector interface scheme of the industry standard for twenty-five pair cable.

SUMMARY OF THE INVENTION:

The present invention has, as its primary object, the provision of improved practice and apparatus for telephone interconnection which accommodate field changes in installation.

A more particular object of the invention is to provide improved method and system for termination of twenty-five pair telephone cable.

In attaining the foregoing and other objects, the invention provides an electrical connector serving as a jack or plug for connection to multiconductor telephone cable and having contacts in modular configuration. The connector includes a housing having an aperture for receiving an insert member and support surface extending outwardly of the aperture. Included are a plurality of contacts having first end portions for external engagement and second end portions of insulation-displacing type. An insert member supports the contacts and is resident in the housing aperture with the first and second end portions of the contacts extending to respective first and second contacts ends on a common side of the insert member, the first end portions being disposed in the housing in modular telephone configuration and the second end portions being located adjacent the support surface. A conductor support element secures the conductors therein and is engaged with the housing to place the conductors in insulation-displaced engagement with the second end portions of the contacts.

In aspect relating to telephone cable having larger numbers of conductors, e.g., twenty-five pair, the invention provides an electrical connector also for use with plugs or jacks having contacts in modular telephone configuration. The connector includes in a particularly preferred arrangement a base having first and second compartments separated by a fold section, each compartment having an opening distal from the fold section, and a set of guides for disposition of conductors of a multiconductor cable in preselected pattern between the opening and the fold section, the fold section providing for residence of the conductors outwardly of the compartments. A plurality of contacts are provided, the contacts having first end portions for external engagement in modular telephone configuration and second end portions of insulation-displacing type. A housing is disposed in each compartment and supports the contacts with the contact first end portions in facing relation to such opening of the compartment and with the contact second end portions in electrical engagement with the conductors in the compartment. The base is folded about the fold section and secured in such folded configuration, the housings in the first and second compartments thus being disposed in abutting relation.

The foregoing and other objects and features of the invention will be further understood from the following detailed description of preferred embodiments and practices and from the drawings wherein like reference numerals identify like parts throughout.

DESCRIPTION OF THE DRAWINGS

FIG. 7 is a sectional elevation of the assembly of the FIG. 4 insert and a contact set as would be seen from line VII—VII of FIGS. 5 and 6.

FIG. 8 is a front elevation of the FIG. 7 assembly.

FIG. 9 is a rear elevation view of the jack housing of FIG. 3.

FIG. 10 is a front elevation of the jack housing of FIG. 3.

DESCRIPTION OF PREFERRED EMBODIMENTS AND PRACTICES

Figure 1:
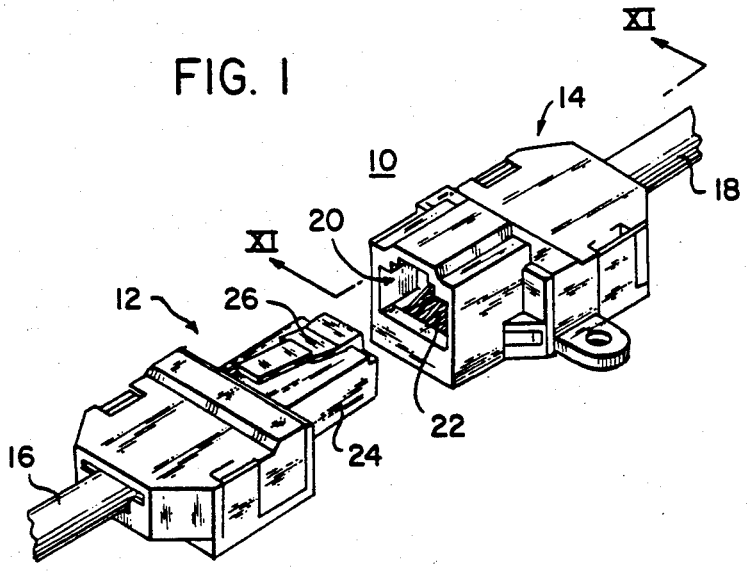
FIG. 1 is an exploded view of a telephone plug and jack in accordance with the invention.

Referring to FIG. 1, a telephone connector assembly 10 includes a plug 12 and a jack 14, each connected to a multiconductor cable, indicated at 16 and 18, respectively. Such cables typically include four, six, or eight discrete conductors which may be in a round or flat cable. An industry standard exists as to the configuration of jack opening 20 and contact end portions 22, as well as for the geometry of plug nose 24 and plug contacts (not shown), which mate with contact end portions 22 upon assembly of the plug and jack. Likewise, the latch 26 and corresponding detent 28 are industry standards.

Figure 2:
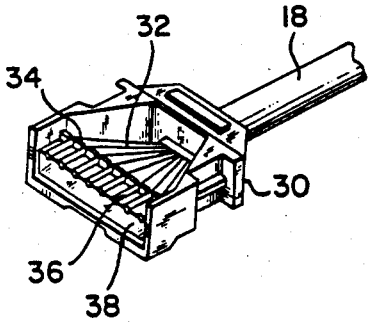
FIG. 2 is a perspective view of the conductor support element of the FIG. 1 jack, inverted from its FIG. 1 disposition.

FIG. 2 shows a conductor support element 30 for use in the present invention. As shown, the conductors of cable 18, eight in number and identified at 32, are dressed individually between adjacent guides or projections 34 to register with through-slots 36 underlying the conductors and adapted to receive insulation-displacing contacts (IDC) after they have become electrically connected to conductors 32. As indicated, the conductors are cut flush with surface 38.

Figure 3:
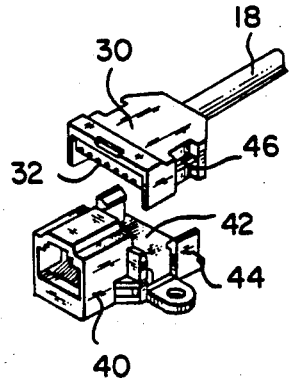
FIG. 3 is an exploded perspective view of the FIG. 1 jack.
Figure 4:
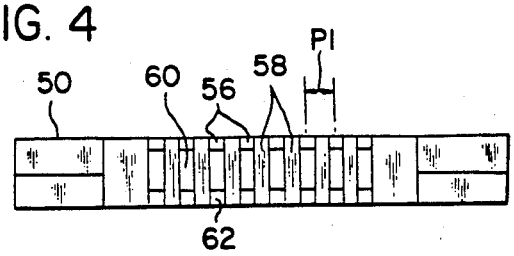
FIG. 4 is a front elevation of an insert for the FIG. 1 jack.

Following completion of FIG. 2 assembly, the same is inverted, as in FIG. 3, and pressed downwardly into assembly with jack housing 40, more specifically onto support surface 42 of housing 40. Latches 44 engage detents 46 to secure this assembly. In the course of the assembly, insulation-displacing contacts (not shown) on support surface 42 engage, and become electrically connected with conductors 32, whereby conductors 32 are electrically continuous with discrete ones of contact end portions 22, contact end portions 22 being disposed for external electrical connection, i.e., to the contacts in plug 12.

Turning to FIGS. 4–8, an insert 50 is adapted for receiving a contact element set, each contact including one of end portions 22, one of insulation-displacing contact end portions 52 and a central extent 54 joining the end portions electrically (FIG. 7). On its upper surface (FIG. 5), insert 50 includes grooves 56, which are at a first pitch (P1 of FIG. 4) corresponding to the pitch of contact end portions 22. Ribs 58 define the grooves, the ribs extending outwardly beyond a bend surface 60. On its undersurface (FIG. 6) insert 50 defines a family of grooves 62 having a pitch change corresponding to the transition required from pitch P1 to the pitch P2 of insulation-piercing contact end portions 52.

Insert 50 defines, at its end opposite bend surface 60, a series of discrete channels 64. As is seen in FIGS. 7 and 8, contact end portions 52 are resident in channels 64 and extend upstandingly to an end 52*a* vertically below the ends 22*a* of contact end portions 22.

Turning to FIG. 9, which depicts jack housing 40 rearwardly in FIG. 3, an opening 66 is provided above support surface 42 and extends inwardly below comb structure 68. Comb structure 68 is integral with jack housing 40 which, as in the case of insert 50, is of electrically insulative material. Teeth 70 thereof are spaced transversely in elongate jack housing 40 and define channels 72. The teeth extend vertically downwardly of an acutely inclined overhang 74. The comb structure is also viewable in FIG. 10 from the frontward side of the housing and has extent running longitudinally with the housing 40, as is seen in the sectioned view of FIG. 11.

Figure 5:
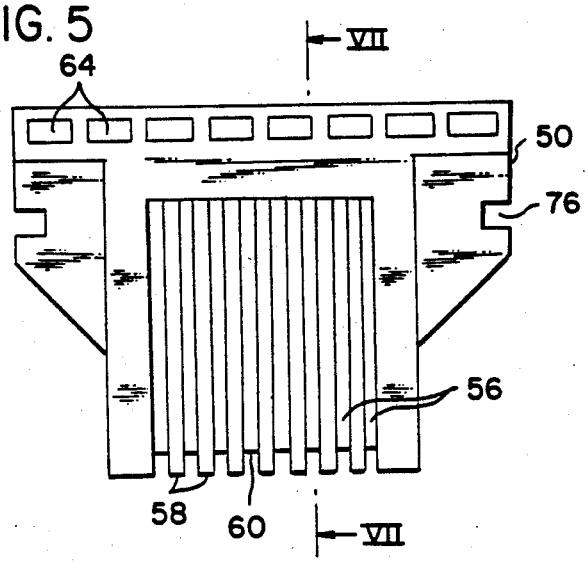
FIG. 5 is a top plan view of the FIG. 4 insert.
Figure 6:
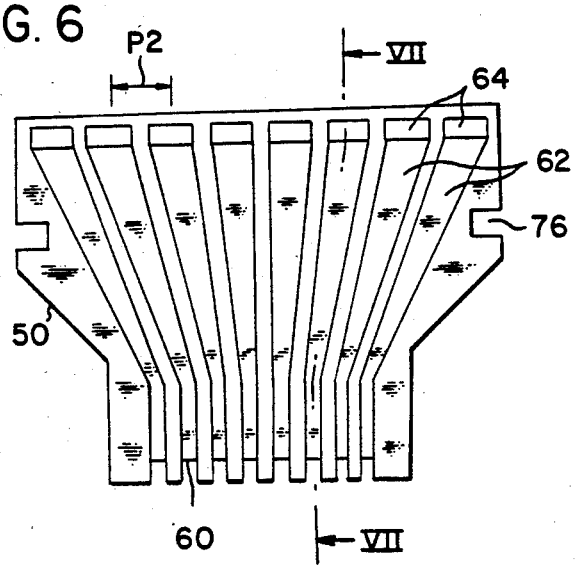
FIG. 6 is a bottom plan view of the FIG. 4 insert.
Figure 11:
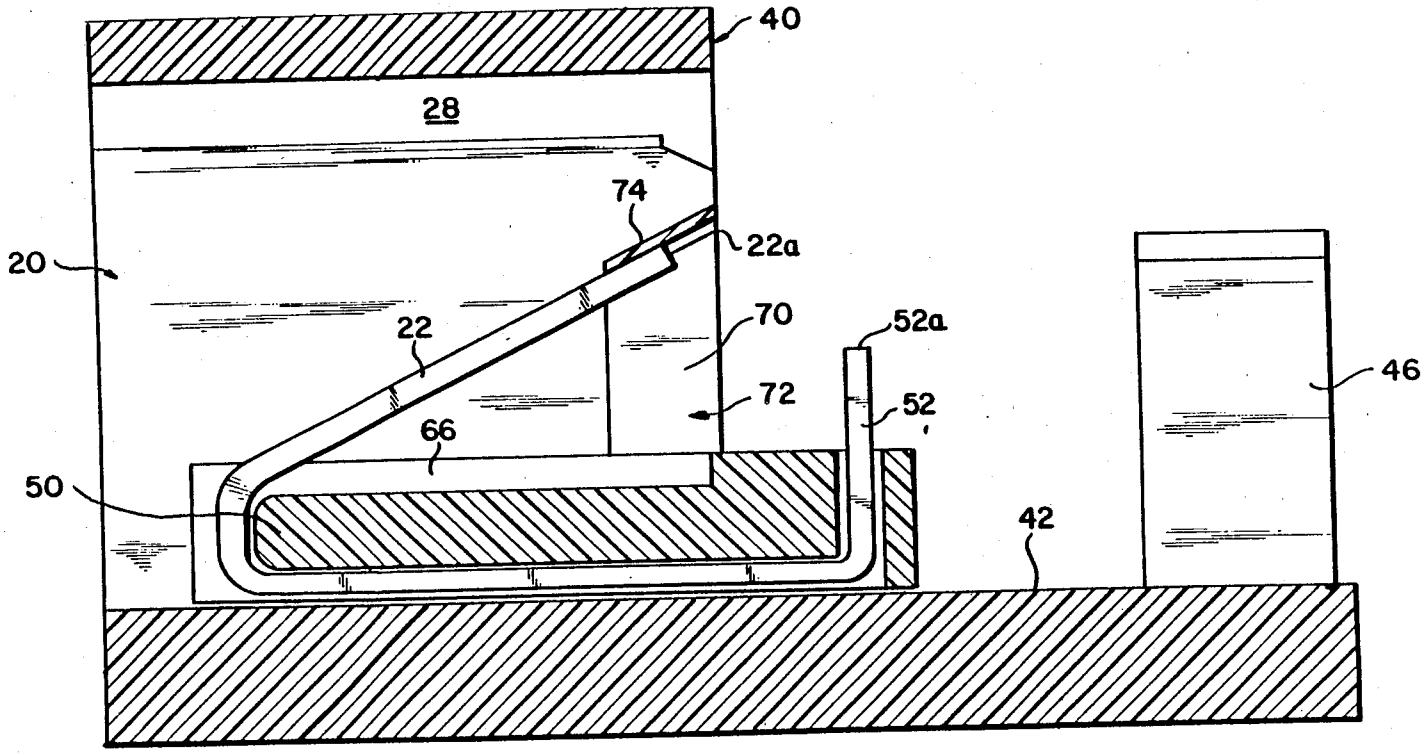
FIG. 11 is a sectional view of an assembled jack as would be seen from plane XI—XI of FIG. 1.

In reaching the FIG. 11 assembly, one takes the subassembly of FIGS. 7 and 8 and forces insert 50 into opening 66. In the course of such insertion, contact end portions 22 pass into the channels 72 of comb structure 68 and confront overhang 74, whereupon they are bent about bend surface 60 to assume the configuration illustrated in FIG. 11, at which junction insert 50 is fully seated in jack housing 40 and retained therein by engagement of housing 40 with insert slots 76 (FIG. 5). Upon receipt of the plug nose 24 into the jack opening 20, the contact end portions 22 resiliently deflect as electrical engagement is made with the plug contacts.

While the construction of the jack 14 has been described herein, it should be appreciated that the plug 12 is assembled in a similar manner in accordance with the invention. In the plug 12, however, the contact end portions that are adapted for external connection, i.e., to the jack contacts, are supportably retained by an insert in the plug housing in fixed position in the modular configuration as opposed to the resiliently deflectable disposition of the jack contacts.

In its adaptability to termination of cable of few conductors, the plug or jack of the invention has contacts arranged in modular telephone configuration and includes a housing having an aperture for receiving an insert member. Contact means are provided comprising a plurality of contacts having first end portions for external electrical engagement and second end portions of insulation-displacing type for interconnection with corresponding electrical conductors. An insert member supporting the contact means and resident in the housing disposes the contacts with their respective first and second ends on a common side of the insert member and with the first end portions in such modular telephone configuration. A conductor support element secures the conductors in the housing to place the conductors in insulation-displaced engagement with the contact means second end portions.

Figure 12:
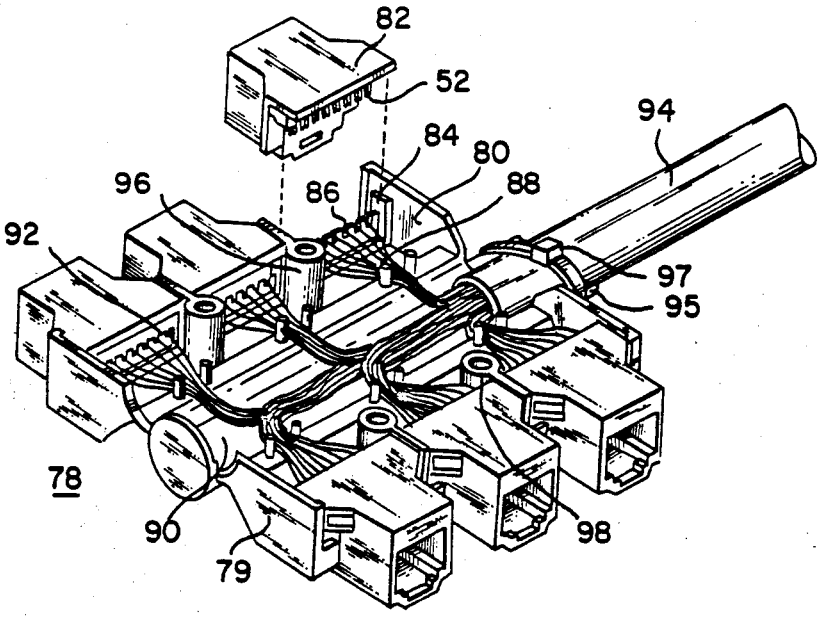
FIG. 12 is a perspective exploded view of a further embodiment of the invention.

Turning to FIG. 12, connector 78 is adapted for use with a twenty-five pair multiconductor cable and is shown in its open unassembled configuration. Connector 78 includes a base 79 having six individual compartments, one being shown at 80. Housing 82 corresponds to jack housing 40, above discussed, except that the latch (44 of FIG. 3) is omitted. Conductor dressing guide or support element 84 is seated in compartment 80 and includes projection set 86, through which the cable conductors 88 are dressed from a central channel in a fold section 90 through strain relief posts 92. In assembly, housing 82 is forced downwardly into compartment 80. Electrical contact is made, as discussed above, between conductors 88 of cable 94 and contact end portions 52 supported by housing 82.

To facilitate handling and assembly of the connector 78, a semicircular collar 95 is preferably integrally attached to the fold section 90 and extends axially therewith, collar 95 being formed to seat the cable 94 therein. A self-locking cable strap 97, or other suitable securement means, is wrapped tightly around the collar 95 and the cable 94, thereby holding the cable 94 in fixed position relative to the connector 78. In addition to providing strain relief for the cable 94, the collar/strap arrangement enables the assembler to freely manipulate the individual cable conductors 88 into the repective compartments 80 for subsequent electrical connection as the cable 94 and connector 78 are held together.

Figure 13:
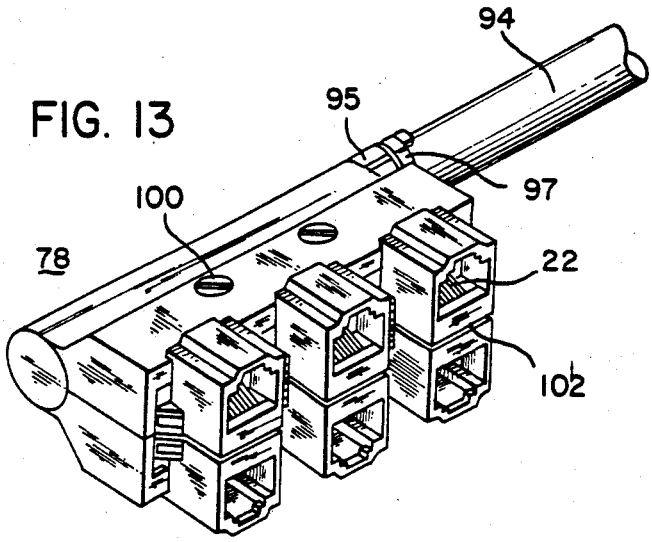
FIG. 13 is a perspective view of the assembled form of the connector of FIG. 12.

In the illustrative showing of FIG. 12, a twenty-five pair cable is shown and eight individual conductors are distributed into each of the six connector compartments. The respective halves of the connector include posts 96 and 98, which register upon closing of the halves of the housing onto one another by bending of the halves about the fold section, which also defines central channel 90. At that juncture, as illustrated in FIG. 13, screws 100 are passed into the posts, engaging internal threading on the lower posts and providing a secured connector assembly. As will be observed, the respective jack housings are thus disposed in abutting pairs, as indicated at 102, one serving as a retainer for the other in the assembly and thus dispensing with need for latches individually associated with the jack housings.

The connector of FIGS. 12 and 13 realizes a reduction of connection interfaces between modular telephone plug contacts and twenty-five pair multiconductor cable. The present industry standard for this interconnection involves as much as five connection interfaces from the cable to the telephone jack contacts matable with the plug contacts. In current industry standard practice, the conductors of the telephone cable are first terminated collectively to a secondary plug. This plug (first interface) connects to a secondary jack defining a second interface. The secondary jack has a conductor-to-conductor third interface therein. The secondary jack output conductors are led to a splice having an interface (fourth) with same and an interface (fifth) with the contacts of the primary jack which presents its output contacts for mating with the primary plug contacts.

In the FIGS. 12 and 13 connector, telephone cable conductors have a single interface with the modular telephone jack output contact end portions 22, which are to engage the modular plug contacts. Thus, insulation-displacing contact end portions 52 are the only interface as between conductors of the multiconductor cable and end portions 22.

Figure 14:
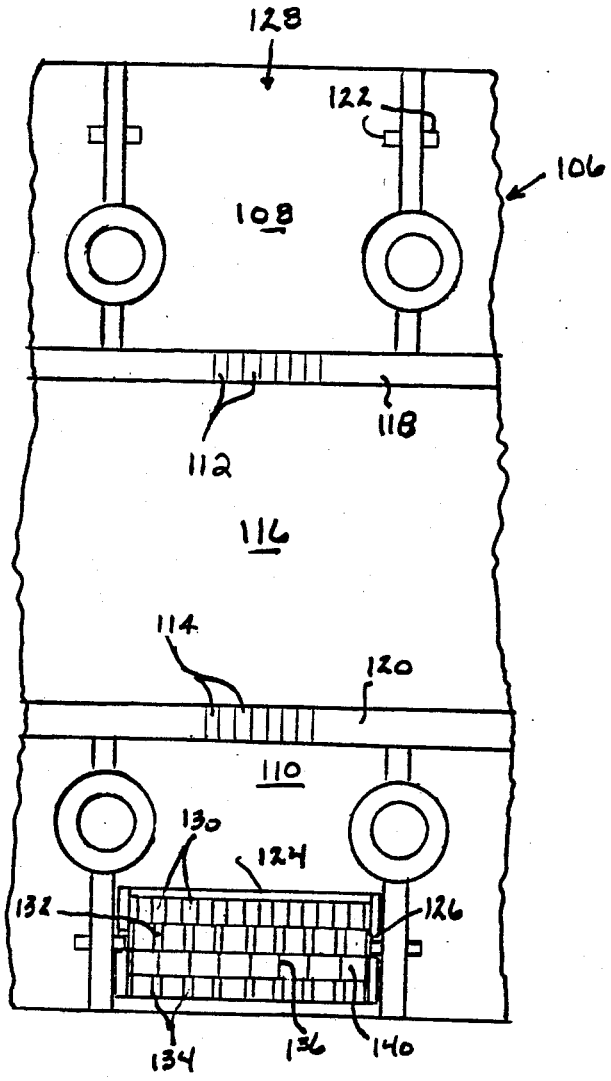
FIG. 14 is a partial top plan view of a preferred alternate embodiment of the connector of FIGS. 13 and 14.
Figure 15:
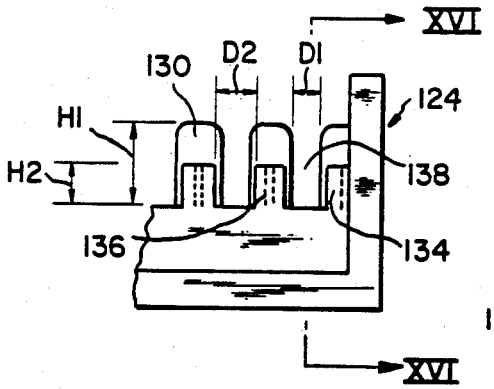
FIG. 15 is a partial front elevation of the conductor support element of FIG. 14.
Figure 16:
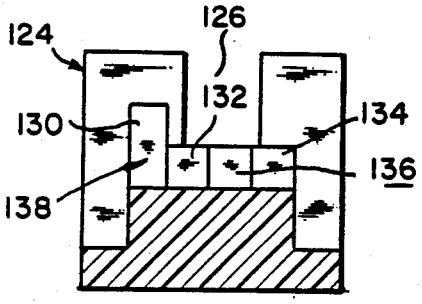
FIG. 16 is a sectional view as would be seen from plane XVI—XVI of FIG. 15.

Referring now to FIGS. 14–16, connector base 106 is a preferred alternate to base 79 of FIGS. 12 and 13. Here, compartments 108 and 110 communicate through transverse channels 112 and 114 with elongate central fold section 116. Channels 112 and 114 are integral depressions in compartment walls 118 and 120, respectively, and serve as strain relief elements, two cable conductors being dressed into each channel.

Ribs 122 extend into the plane of FIG. 14, i.e., run depthwise with the compartments and serve to receive conductor support element 124, the ribs residing in slots 126 which extend vertically in support element 124 (Fig. 16). Coaction of ribs 122 and the sidewalls of slots 126 is such that support element 124 is restrained against transverse movement in the direction of opening 128 of the compartment, but has freedom of movement outwardly from the plane of FIG. 14, while base 106 is in its open condition.

In the assembly of a connector employing the FIG. 14 base, a support element 124 is inserted into each compartment slidably onto ribs 122. Cable conductors are dressed from fold section 116 through channels 114 and onto the surface of support element 124. The support element has a first set of guides or projections 130 juxtaposed with channels 114 in the illustrative partial assembly of FIG. 14 and a second set of projections 132 and 134, webs 136 extending between projections 132 and 134. Projections 130 are mutually spaced by measure D1 and are of height H1 (FIG. 15). Projections 132 are mutually spaced, as are projections 134, by measure D2 and are of height H2. D1 is selected such that projections 130 more tightly engage conductors dressed into channels 138 than do projections 132 and projections 134. Pockets 140 between adjacent webs 136 seat insulation-displacing contact end portions 52 (FIG. 12) upon full assembly of the connector.

As dressed into channels 138, the conductors are tightly gripped in the first grooves (D1) of the channels and are engaged also in the second groove (D2). The conductors may thereafter be manipulated in the course of dressing other conductors into others of channels 138, without disturbing the pre-dressed conductors, since the above-discussed coaction of ribs 122 and slots 126 effects vertical flotation of support element 124, jointly with its seated conductors.

In its adaptability to use with telephone cables of twenty-five pair or like large conductor number type, the invention provides a connector including a base having pairs of compartments separated by a fold section, each compartment having an opening distal from the fold section and a set of guides for disposition of conductors of a multiconductor cable—in preselected pattern, the fold section providing for residence of the conductors outwardly of the compartments. A housing is situated in each compartment and has an insert member with contacts resident therein with the first end portions of the contacts supported in modular telephone configuration. The base can be folded about the fold section and secured in such folded configuration, whereby a pair of the housings are then disposed in abutting relation.

In particularly preferred connector structure, the invention employs its conductor support member in the form of an insert to the base and the insert defines a set of guides for disposition of conductors of the cable in preselected pattern. The base and the conductor support member have cooperative means for facilitating movement of the conductor support member relative to the base.

In field assembly of terminated telephone cables, one can accordingly effect any desired interconnection without need for factory assembled cable and termination sockets nor inventory thereof. Connectors of the invention will also be seen to be assembled without special tooling, i.e., the customary pliers of the telephone installer fully serve to realize connections in accordance with the inven- tion.

Figure 17:
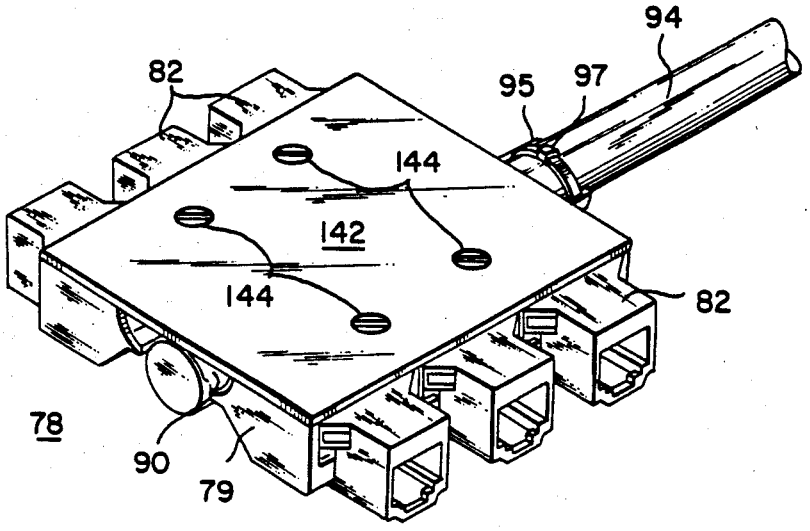
FIG. 17 is a perspective view of the assembled connector of FIG. 12 in a modified form.

Various changes to the structure and modifications in practice may be effected without departing from the scope of the invention. For example, by reference to FIG. 17, it can be seen that instead of folding the connector 78 such that the individual jacks are oriented on the same side, as depicted in FIG. 13, the base 79 may remain flat and unfolded so that the individual jacks are disposed on opposite sides. A plate member 142 may be suitably secured to the base 79 so as to abut the respective jack housings, thereby retaining the jacks in position. Suitable openings 144 may be provided in plate 142 so as to permit wall mounting of the flat connector assembly or for stacking of like connector assemblies. Also, while the twenty-five pair connector has been described herein as having plural jacks electrically connected to the conductors of a telephone cable, it should be appreciated that, if desired, plugs may be used. Thus, the particularly depicted embodiments and described practices are intended to be illustrative and not limiting in scope. The true scope of the invention is set forth in the following claims.

I claim:

1. An electrical connector for connecting conductors of a multiconductor cable with plugs or jacks having contacts in modular telephone configuration, comprising:

(a) a base having first and second compartments and a channel for residence of said cable conductors, said channel communicating with and separating said first and second compartments;

(b) a housing in each compartment supporting a plurality of contacts, each contact having a first end portion in modular telephone configuration and facing outwardly of said compartments for connection with said plugs or jacks and a second end portion of insulation-displacing type, in electrical engagement with a selected conductor of said cable each of said housings being selectively insertable in one of said base compartments;

(c) means retaining each of said housings in said base; and (d) means holding said cable in a fixed position relative to said base.

2. The connector claimed in claim 1 wherein said retaining means comprises a fold section defining said channel, said base being folded about said fold section such that the housings in said first and second compartments are disposed in abutting relation and further including means for holding said base in such folded condition.

3. The connector claimed in claim 1, wherein said holding means includes a collar attached to said base and securement means attaching said cable to said collar.

4. The connector claimed in claim 3, wherein said collar is semicircular in configuration and integrally secured to said base, and wherein said securement means comprises a cable tying strap secured tightly about a portion of said cable and said collar.

5. The connector claimed in claim 1, wherein said retaining means comprises a plate member secured to said base and in abutting relation to said housings.

6. The connector claimed in claim 5, wherein said plate member includes means for mounting said connector.

7. An electrical connector for connecting conductors of a multiconductor cable with plugs or jacks having contacts in modular telephone configuration, comprising:

(a) a base having a plurality of compartments, each compartment having first and second openings, respectively for receiving said plug or jack and selected conductors of said cable and a channel adjacent said second openings of said compartment for residence of said cable;

(b) a plurality of electrical contacts having first end portions for external electrical engagement and second end portions of insulation-displacing type;

(c) a housing in each said compartment and supporting contacts with said contact first end portions in modular telephone configuration and in facing relation to said first opening of said compartment and with said contact second end portions in electrical engagement with said conductors in said compartment, said housing being insertable in said base compartments to urge said second end portions into insulation-displacing electrical connection with said conductors; and (d) a conductor support member insertable in said base and defining a set of guides for disposition of conductors of said cable in preselected pattern, said base and said conductor support member having cooperative means for facilitating movement of said conductor support member relative to said base.

8. An electrical connector for use with plugs having contacts in modular telephone configuration, comprising:

(a) a base having oppositely extending first and second compartments separated by a fold section, each compartment having an opening distal from said fold section and a set of guides for disposition of conductors of a multiconductor cable in preselected pattern, said fold section providing for residence of said conductors between and outwardly of said compartments;

(b) a plurality of contact means for interconnecting said plug contacts with said conductors, said contact means comprising a plurality of contacts having first end portions for engagement with said plug contacts and second end portions of insulation-displacing type; and (c) a housing in each said compartment and supporting one of said contact means with said contact first end portions in modular telephone configuration adapted to receive one of said plugs and in facing relation to such opening of said compartment and with said contact second end portions in electrical engagement with said conductors in said compartment, said base being folded about said fold section and secured in such folded configuration, the housings in said first and second compartments thus being disposed in abutting relation.

9. The connector claimed in claim 8, wherein said base includes discrete channels for residence of said conductors and discrete pockets registered with said channels for residence of said ends of said contact second end portions.

10. The connector claimed in claim 9, wherein said base further includes first and second sets of projections at respective different-locations for defining said channels.

11. The connector claimed in claim 10, wherein each adjacent pair of said first set projections defines a first conductor dressing groove of one of said channels and each adjacent pair of said second set projections defines a second conductor dressing groove of one of said channels, such first groove being of cross-section exceeding the cross-section of such second groove.

12. The connector claimed in claim 11, wherein said second projection set is disposed closer to said fold section than said first projection set.

13. The connector claimed in claim 8, wherein said base includes discrete channels for residence of said conductors and discrete pockets registered with said channels for residence of said ends of said contact second end portions.

14. The connector claimed in claim 13, further including a conductor support member insertable in said base for defining said channels and said pockets.

15. The connector claimed in claim 14, wherein said base includes ribs in each said compartment, said conductor support member having slots coactive with said ribs to facilitate movement of said insert member in said compartment.

16. An electrical connector for use with plugs having contacts in modular telephone configuration, comprising:

(a) a base having at least one pair of opposedly extending compartments separated by a fold section, each compartment having an opening distal from said fold section and a set of guides for disposition of conductors of a multiconductor cable in preselected pattern, said fold section providing for residence of said conductors outwardly of said compartments;

(b) contact means for interconnecting said plug contacts with said conductors, said contact means comprising a plurality of contacts having first end portions for engagement with said plug contacts and second end portions of insulation-displacing type;

(c) a housing insertable in each said compartment and having an aperture for receiving an insert member; and (d) an insert member resident in each said housing and supporting said contact means with said first end portions of said contacts supported in modular telephone configuration, said housing terminating said conductors in an insulation displacing manner upon insertion of said housing in said compartment, said base being folded about said fold section and secured in such folded configuration, a pair of said housing thus being disposed in abutting relation.

* * * * *